US011832690B2

(12) United States Patent
Steinke, II

(10) Patent No.: US 11,832,690 B2
(45) **Date of Patent: *Dec. 5, 2023**

(54) SNAP AND LOCK

(71) Applicant: Richard P. Steinke, II, Indio, CA (US)

(72) Inventor: Richard P. Steinke, II, Indio, CA (US)

( * ) Notice: Subject to any disclaimer, the term of this patent is extended or adjusted under 35 U.S.C. 154(b) by 313 days.

This patent is subject to a terminal disclaimer.

(21) Appl. No.: 16/019,393

(22) Filed: Jun. 26, 2018

(65) Prior Publication Data

US 2018/0368531 A1 Dec. 27, 2018

Related U.S. Application Data

(63) Continuation-in-part of application No. 15/873,168, filed on Jan. 17, 2018.

(60) Provisional application No. 62/447,344, filed on Jan. 17, 2017.

(51) Int. Cl.

| | |
|---|---|
| ***A44B 1/32*** | (2006.01) |
| ***A44B 1/08*** | (2006.01) |
| ***A44B 1/34*** | (2006.01) |
| *A44B 17/00* | (2006.01) |

(52) U.S. Cl.

CPC ..... *A44B 1/32* (2013.01); *A44B 1/08* (2013.01); *A44B 1/34* (2013.01); *A44B 17/0076* (2013.01); *A44D 2200/10* (2013.01); *A44D 2201/50* (2013.01)

(58) Field of Classification Search

CPC ..... A44B 17/0005; A44B 17/0023; A44B 17/0052; A44B 17/007; A44B 17/0082; A44B 1/32; A44B 1/08; A44B 1/34; A44B 17/0076; A44D 2201/04; A44D 2201/06; A44D 2200/10; A44D 2201/50

See application file for complete search history.

(56) References Cited

U.S. PATENT DOCUMENTS

| | | | | | |
|---|---|---|---|---|---|
| 2,723,433 | A | * | 11/1955 | Buren, Jr. | A44B 17/0005 24/90.1 |
| 3,045,309 | A | * | 7/1962 | Johnson, Sr. | A44B 17/0082 24/689 |
| 3,111,737 | A | * | 11/1963 | Heil | A41F 1/002 24/303 |
| 3,718,950 | A | * | 3/1973 | Engstrom | F16B 5/0642 24/613 |
| 4,137,607 | A | * | 2/1979 | Kramer | A44B 1/04 24/95 |
| 4,480,361 | A | * | 11/1984 | Morita | A45C 13/1069 24/303 |
| 4,505,007 | A | * | 3/1985 | Aoki | A41F 1/002 24/303 |

(Continued)

*Primary Examiner* — David M Upchurch

(74) *Attorney, Agent, or Firm* — LAW OFFICE OF MICHAEL O'BRIEN; Michael O'Brien

(57) ABSTRACT

A button system containing two pieces that snap and lock together to fasten multiple articles of clothing. The top piece is made of three distinct parts: a detachable ridged color-coded cover, a fastener that attaches said cover to a rotatable hinged plate, and a fastener that secures all three pieces of the top piece. The bottom piece is also made up of three distinct parts: a plate to receive the hinges from the top piece, a curved structure that connects the hinge/cavity plates to the article of clothing, and a rivet that attaches to the article of clothing and the snap and lock invention.

1 Claim, 15 Drawing Sheets

(56) References Cited

U.S. PATENT DOCUMENTS 4,580,320 A * 4/1986 Takata ..... A44B 1/02 24/113 MP
4,959,890 A * 10/1990 Pazurek ..... A44B 1/04 24/113 MP
5,042,116 A * 8/1991 Ossiani ..... A45C 13/1069 24/303
5,253,394 A * 10/1993 Morita ..... A41F 1/002 24/303
5,451,082 A * 9/1995 Murai ..... E05C 1/10 292/246
5,515,581 A * 5/1996 Kaufmann ..... A45C 13/1069 24/303
6,295,702 B1 * 10/2001 Bauer ..... A45C 13/1069 24/303
6,564,434 B1 * 5/2003 Morita ..... A45C 13/1069 24/114.2
6,796,344 B2 * 9/2004 Chen ..... A45C 1/024 150/113
7,246,384 B2 * 7/2007 Bentz ..... A42B 3/08 2/421
7,277,239 B2 * 10/2007 Carnevali ..... G02B 25/005 359/802
7,277,240 B2 * 10/2007 Carnevali ..... G02B 25/005 359/802
7,464,813 B2 * 12/2008 Carnevali ..... G06F 1/1626 206/320
7,464,814 B2 * 12/2008 Carnevali ..... G06F 1/1626 206/320
7,640,636 B2 * 1/2010 Clark ..... A44C 17/0216 24/303
7,772,948 B2 * 8/2010 Grow ..... H01F 7/0231 335/285
7,850,032 B2 * 12/2010 Carnevali ..... B63B 49/00 220/4.22
8,353,544 B2 * 1/2013 Fiedler ..... E05B 15/04 292/318
8,794,682 B2 * 8/2014 Fiedler ..... E05B 15/04 292/251.5
9,010,537 B2 * 4/2015 Carnevali ..... G06F 1/1628 206/777
9,195,279 B2 * 11/2015 Carnevali ..... G06F 1/1616
9,307,806 B1 * 4/2016 Dorman ..... A44B 1/14
9,331,444 B2 * 5/2016 Carnevali ..... G06F 1/1628
9,529,387 B2 * 12/2016 Carnevali ..... G06F 1/1628
9,602,639 B2 * 3/2017 Carnevali ..... H04M 1/0274
9,674,975 B2 * 6/2017 Carnevali ..... H04B 1/3888
9,706,026 B2 * 7/2017 Carnevali ..... H04M 1/04
9,756,930 B2 * 9/2017 Hanchett ..... A45F 5/02
9,831,904 B1 * 11/2017 Carnevali ..... G06F 1/1632
10,050,658 B2 * 8/2018 Carnevali ..... G06F 1/1628
10,401,905 B2 * 9/2019 Carnevali ..... G06F 1/1626
10,646,787 B2 * 5/2020 Cheung ..... A63H 27/001
10,812,643 B1 * 10/2020 Carnevali ..... F21V 23/0485
10,813,417 B2 * 10/2020 Quinn ..... A44B 17/0017
11,029,731 B1 * 6/2021 Carnevali ..... H04M 1/04
11,076,032 B1 * 7/2021 Carnevali ..... F16M 11/041
2005/0223527 A1 * 10/2005 Raccosta ..... A44B 17/0052 24/90.1
2011/0225781 A1 * 9/2011 Cameron ..... A44B 1/04 24/459
2012/0079645 A1 * 4/2012 Carlson ..... A41B 13/08 2/265
2014/0317822 A1 * 10/2014 Friedman ..... A44B 17/0082 2/69
2015/0053060 A1 * 2/2015 Coakley ..... B23D 21/04 83/745
2016/0000189 A1 * 1/2016 Bolen ..... A44B 1/08 24/303
2016/0270487 A1 * 9/2016 Chen ..... A44B 17/0023
2017/0210611 A1 * 7/2017 Bingham ..... B68G 13/02
2017/0288338 A1 * 10/2017 Komoto ..... H01R 13/26

* cited by examiner

SNAP AND LOCK

BACKGROUND

Field of the Invention

This invention relates to the field of buttons, specifically fasteners for articles of clothing.

Description of the Related Art

Traditional buttons have long been used to easily fasten multiple articles of clothing together. A negative trait of the ease of traditional buttons is the ease at which they become undone. The present invention sets forth a novel system to allow the user to rotate the fastening device into a locked position to secure multiple articles of clothing and prevent unwanted detachment of said articles of clothing. This invention is particularly useful in athletics, action sports, and extreme conditions.

SUMMARY

The snap and lock invention is similar to a traditional button designed for an article of clothing, generally two pieces that snap together to fasten multiple articles of clothing.

This invention comprises the traditional two pieces, however, each piece incorporates novel concepts. The top piece is made up of two parts: (1) a ridged cover that is used as both a pressure point to secure the invention, and a grip to rotate the invention in and out of the locked position, and a male fastener that attaches the rigged cover to the (2) plate with hinges that functions as the bottom of the top piece of the snap and lock: The hinged place contains a female fastener that secures the two pieces of the top portion. The bottom piece of the snap and lock invention is made up of three parts: (1) a plate to receive the hinges from the top piece, said plate either closed or open, with a cavity to allow the hinges to rotate approximately 37 degrees into a locked position, and with bumper guards to prevent the hinges from over rotation, (2) a curved structure that serves to connect the hinge/cavity plates and the article of clothing attachment, and (3) a rivet that attaches to the article of clothing and the snap and lock invention. The invention also includes a member device that holds the invention together and guides the installation or assembly.

BRIEF DESCRIPTION OF THE DRAWINGS

The foregoing and other features of the invention will become apparent from the following drawings and detailed description of the preferred embodiment of the invention.

DETAILED DESCRIPTION

Figure 1:
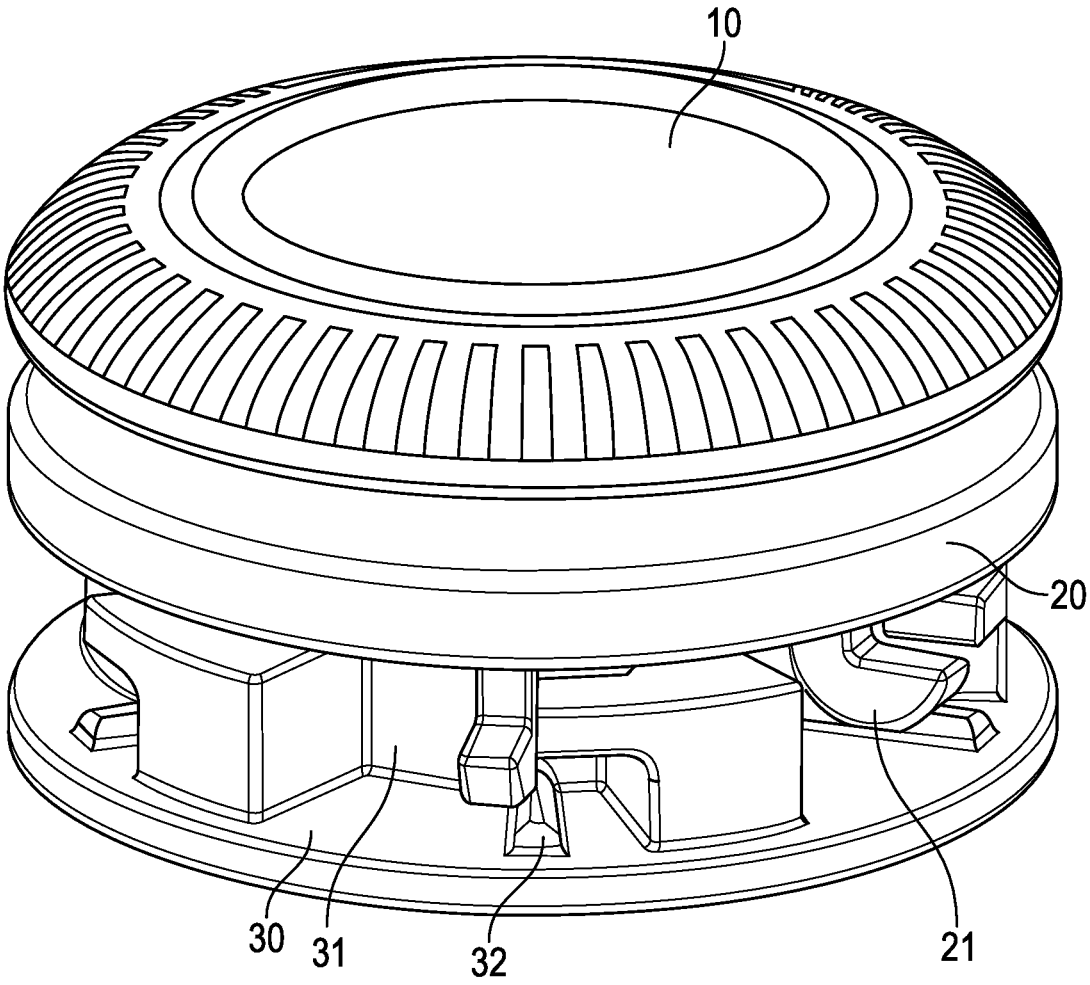
FIG. 1 is a front schematic view of the snap and lock button device open design.

FIG. 1 is a front schematic view of the invention in the preferred embodiment with the open design. The preferred embodiment is not intended to limit the scope of the invention. The preferred embodiment of the invention includes five parts: the ridged top plate 10 containing the star-shaped open clasp male fastener 11, the plate 20 containing the star-shaped open clasp female fastener 22 which connects to plate 10 and also contains hinges 21 on the reverse side of the female fastener, the plate 30 that receives the hinges 21 in cavities 31, a structure 40 that receives the plate 10 and plate 20 and allows the combined plates 10 and 20 to be rotated together into a fixed and secure position, and a rivet 50 that attaches the invention to an article of clothing.

Figure 2:
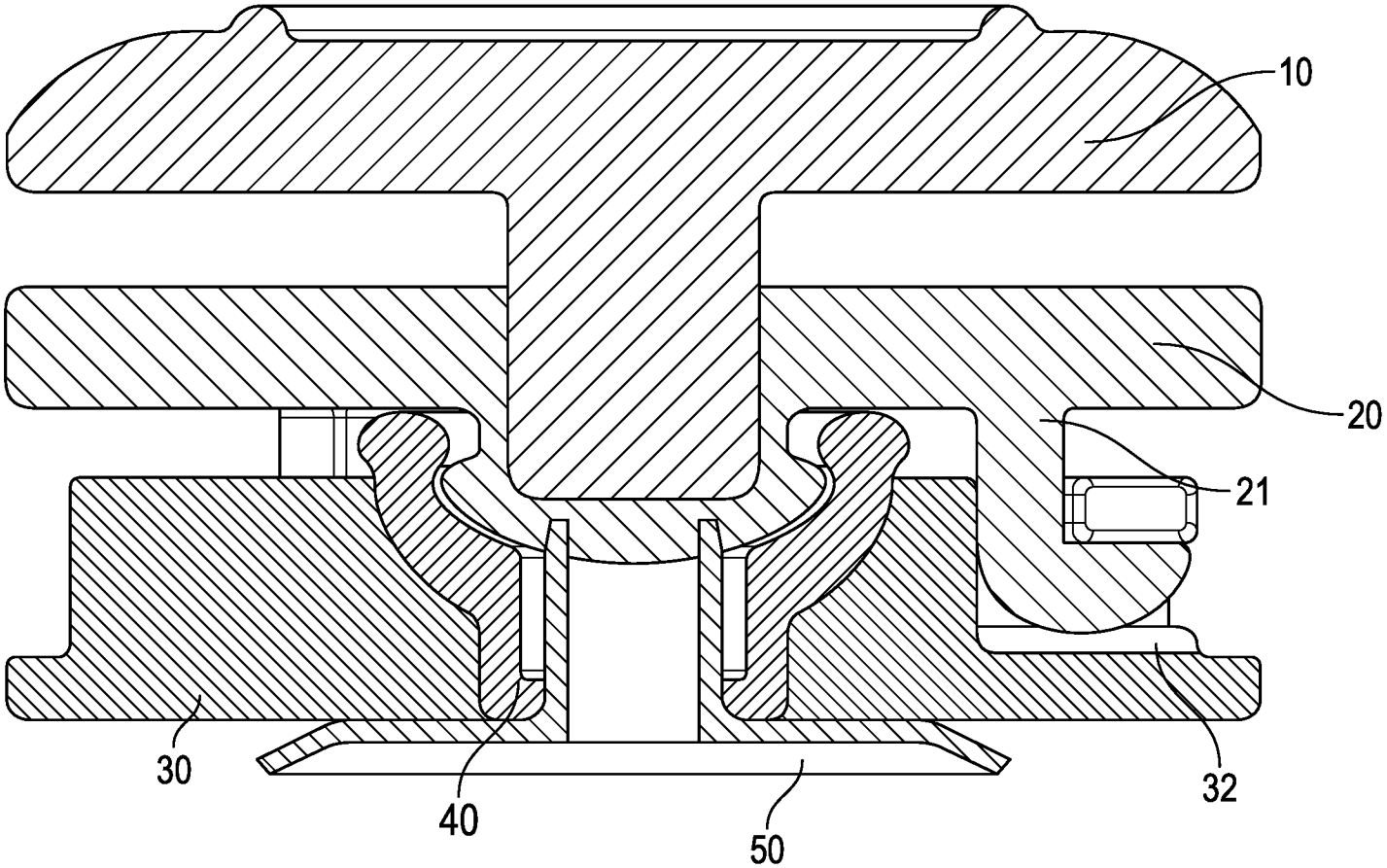
FIG. 2 is a cross-sectional view of the device shown in FIG. 1 taken from the center of the device.

FIG. 2 shows the cross-sectional view of the invention taken from the center of the invention. The ridged top plate 10 is shown attached to plate 20 with fastener 11 inserted to fastener 22 by snapping in place with applied downward force. Plate 20 with hinges 21 is locked in place with plate 30 with hinges 21 inside cavities 31 with said hinges inserted in said cavities and rotated approximately 37 degrees into a locked position. Bumper guides 32 guide hinges 21 into cavities 31 into a locked position keeping them from moving into the text cavity. Plate 20 is shown connected into structure 40 by snapping in place with applied downward force. Rivet 50 is shown detached from the invention and from an article of clothing.

Figure 3A:
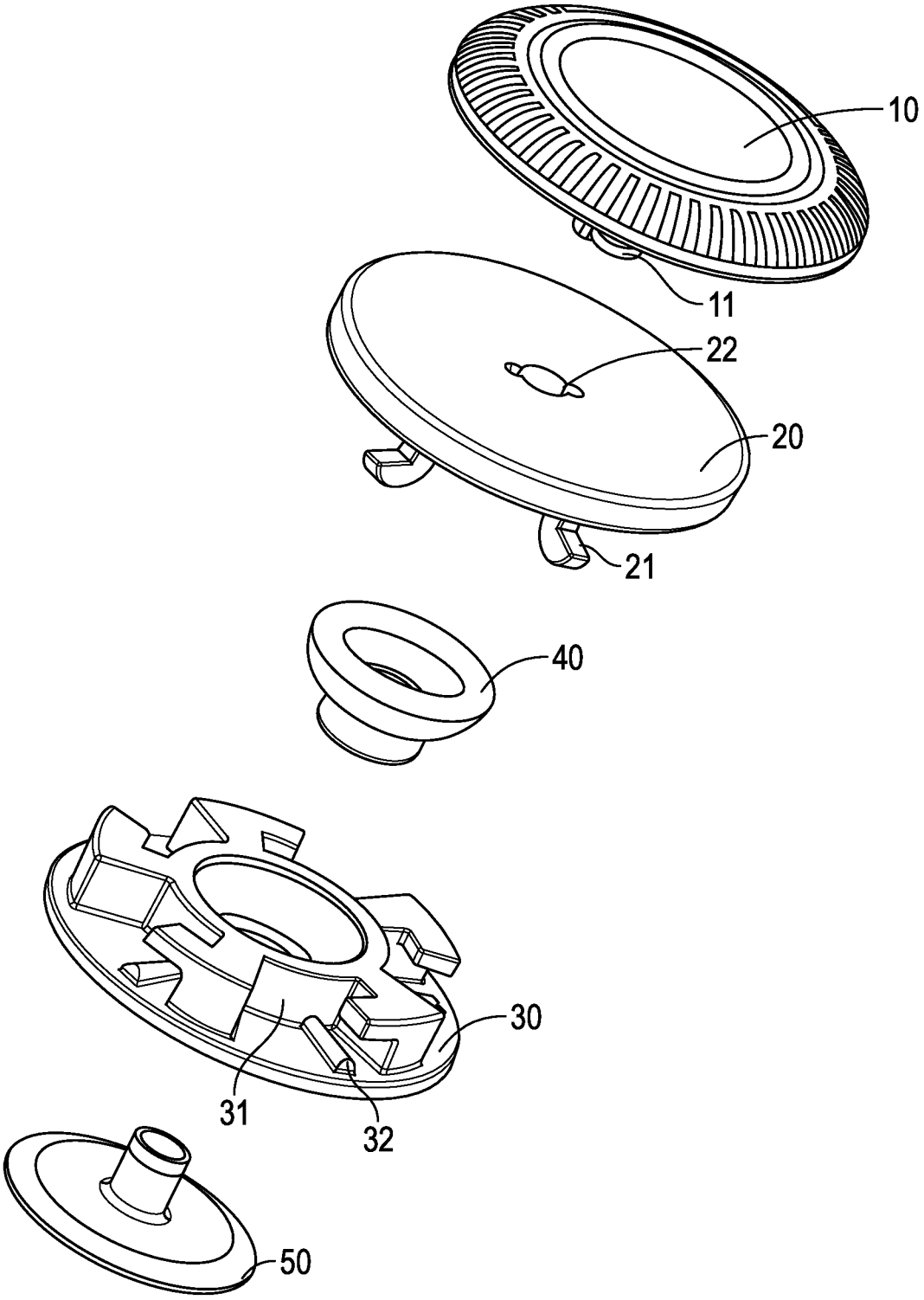
FIG. 3A is a semi-exploded angled view of the device shown in FIG. 1.

FIG. 3A is a semi-exploded view of the invention in the preferred embodiment. The ridged top plate 10 containing the star-shaped open clasp male fastener 11 is shown separated from plate 20. The plate 20 containing the star-shaped open clasp female fastener 22 and hinges 21 is shown detached from the plate 10 containing the male fastener. The plate 20 containing the female fastener and hinges 21 is shown detached from the plate 30 that receives the hinges 21 inside cavities 31 with bumper guides 32.

This FIG. 3A shows the open design for plate 30. Structure 40 that receives the united plate 10 and plate 20 is shown detached. Rivet 50 is shown detached from the invention and from an article of clothing.

Figure 3B:
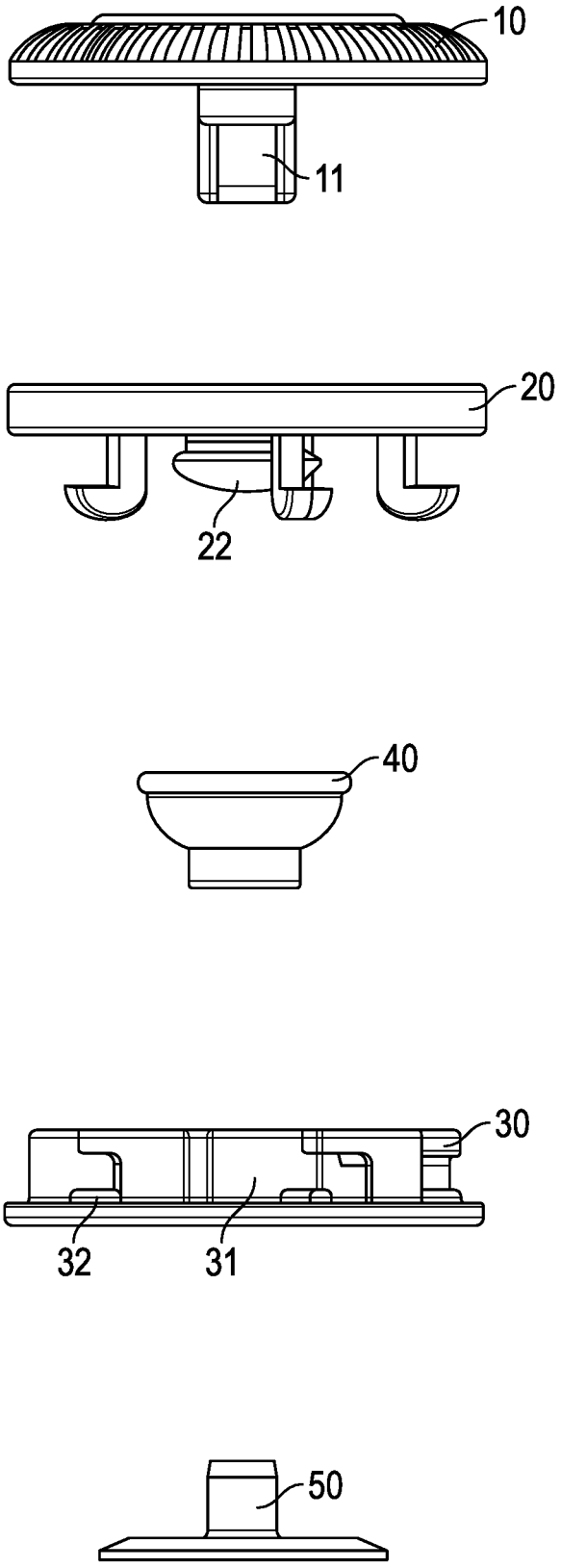
FIG. 3B is a semi-exploded front view of the device shown in FIG. 1.

FIG. 3B is a semi-exploded front view of the invention in the preferred embodiment and while incorporating the detailed description of FIG. 3A above, also shows fastener 11 and fastener 22.

Figure 3C:
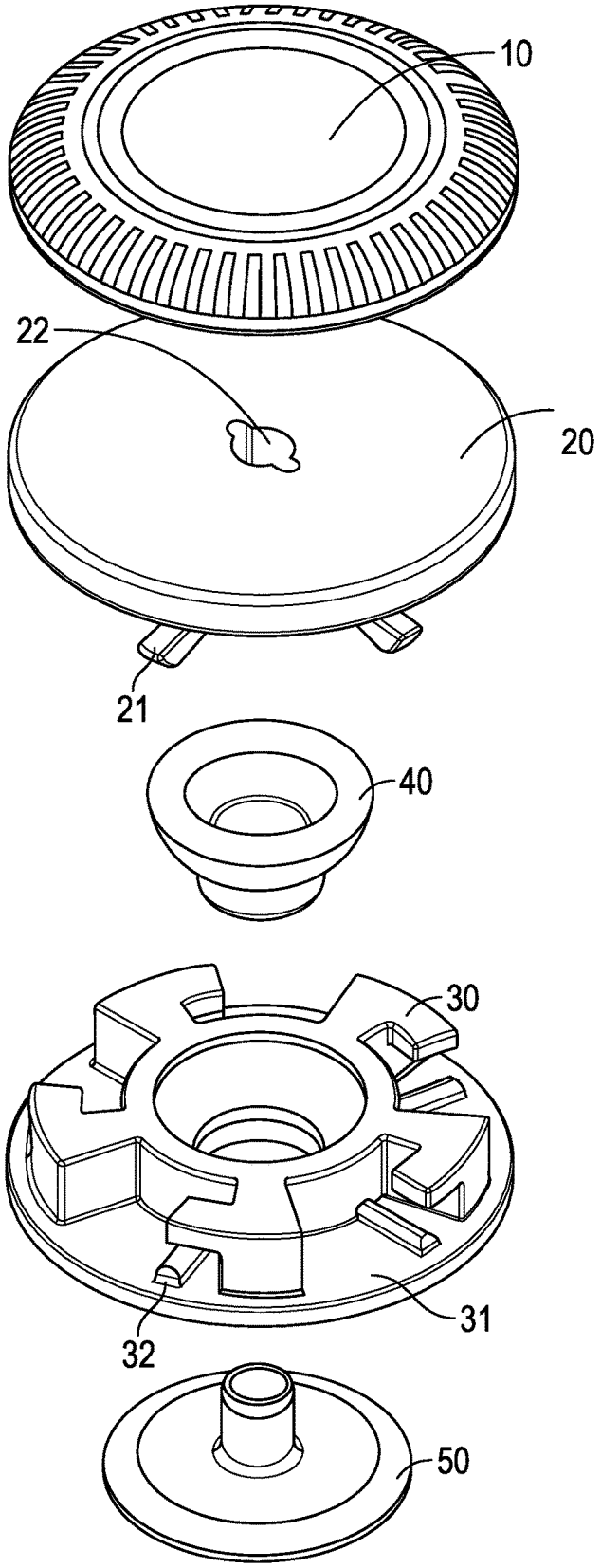
FIG. 3C is a semi-exploded front-angled view of the device shown in FIG. 1.

FIG. 3C is a semi-exploded front-angled view of the invention in the preferred embodiment and while incorporating the detailed description of FIG. 3A above.

Figure 4:
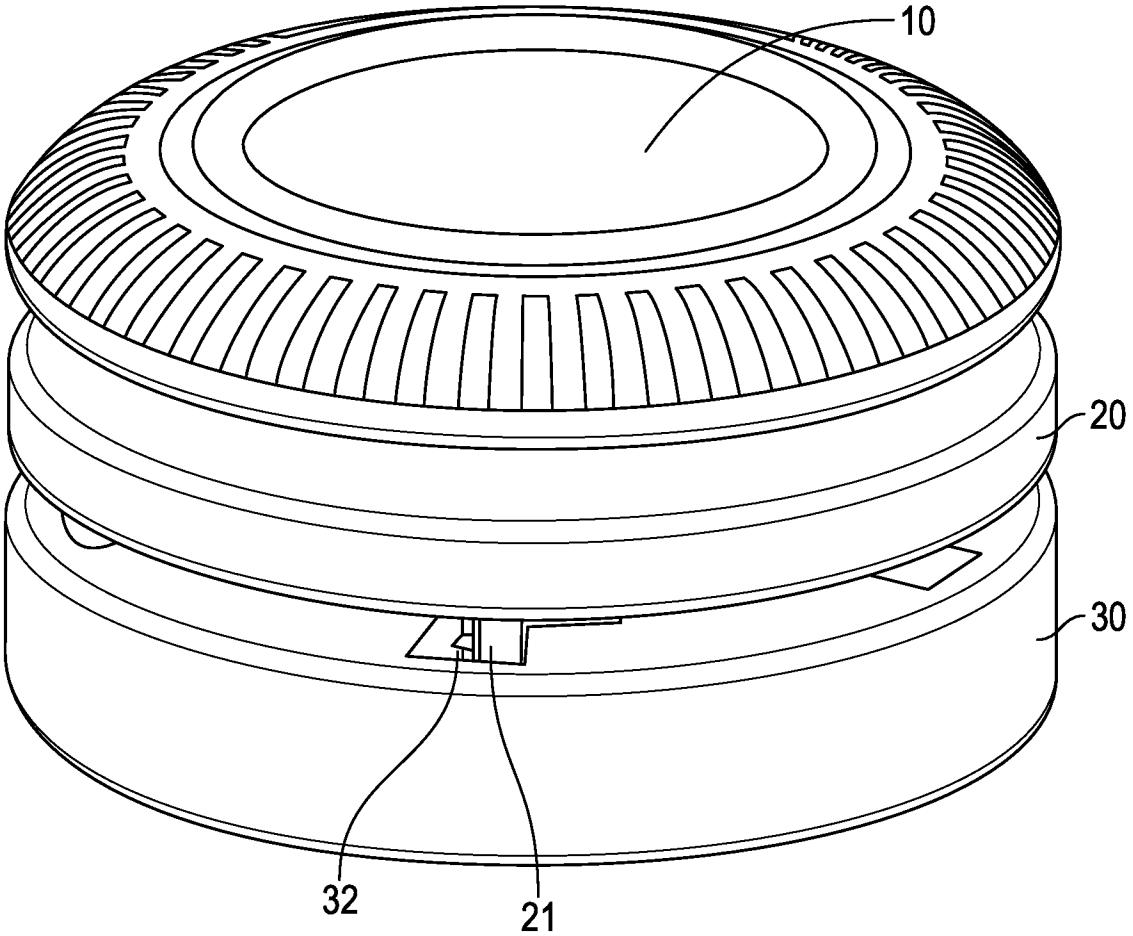
FIG. 4 is a front schematic view of the snap and lock button device closed design.

FIG. 4 is a front schematic view of the invention in the preferred embodiment with the closed design for plate 30, and incorporates the detailed description of FIG. 1.

Figure 5:
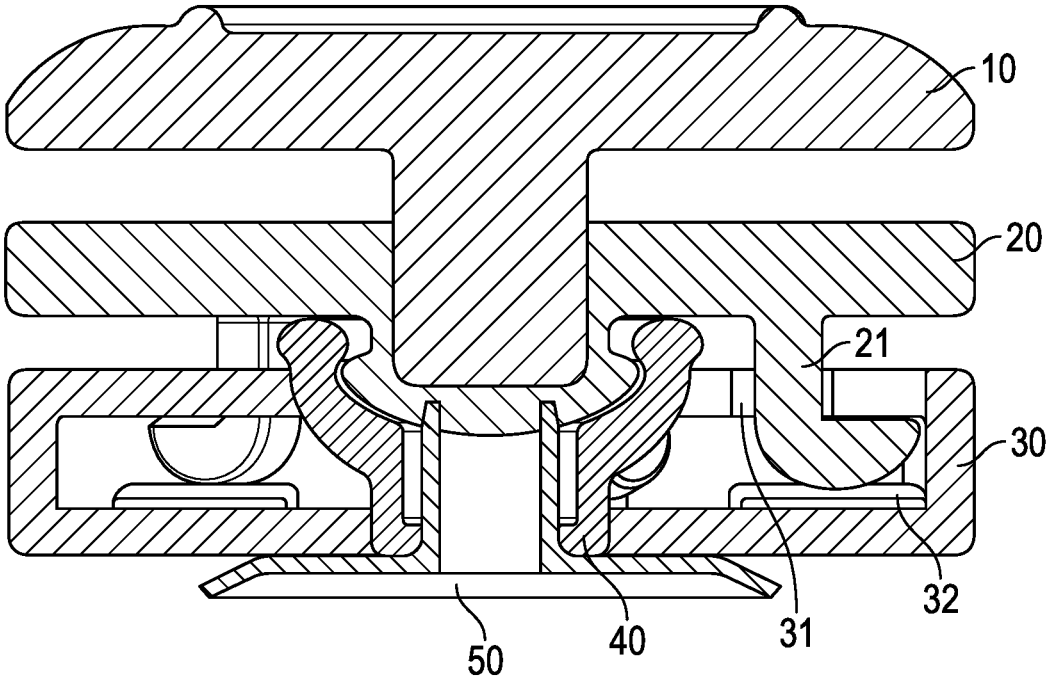
FIG. 5 is a cross-sectional view of the device shown in FIG. 4. taken from the center of the device.

FIG. 5 shows the cross-sectional view of the invention taken from the center of the invention with the closed design for plate 30, and incorporates the detailed description of FIG. 2 above.

Figure 6A:
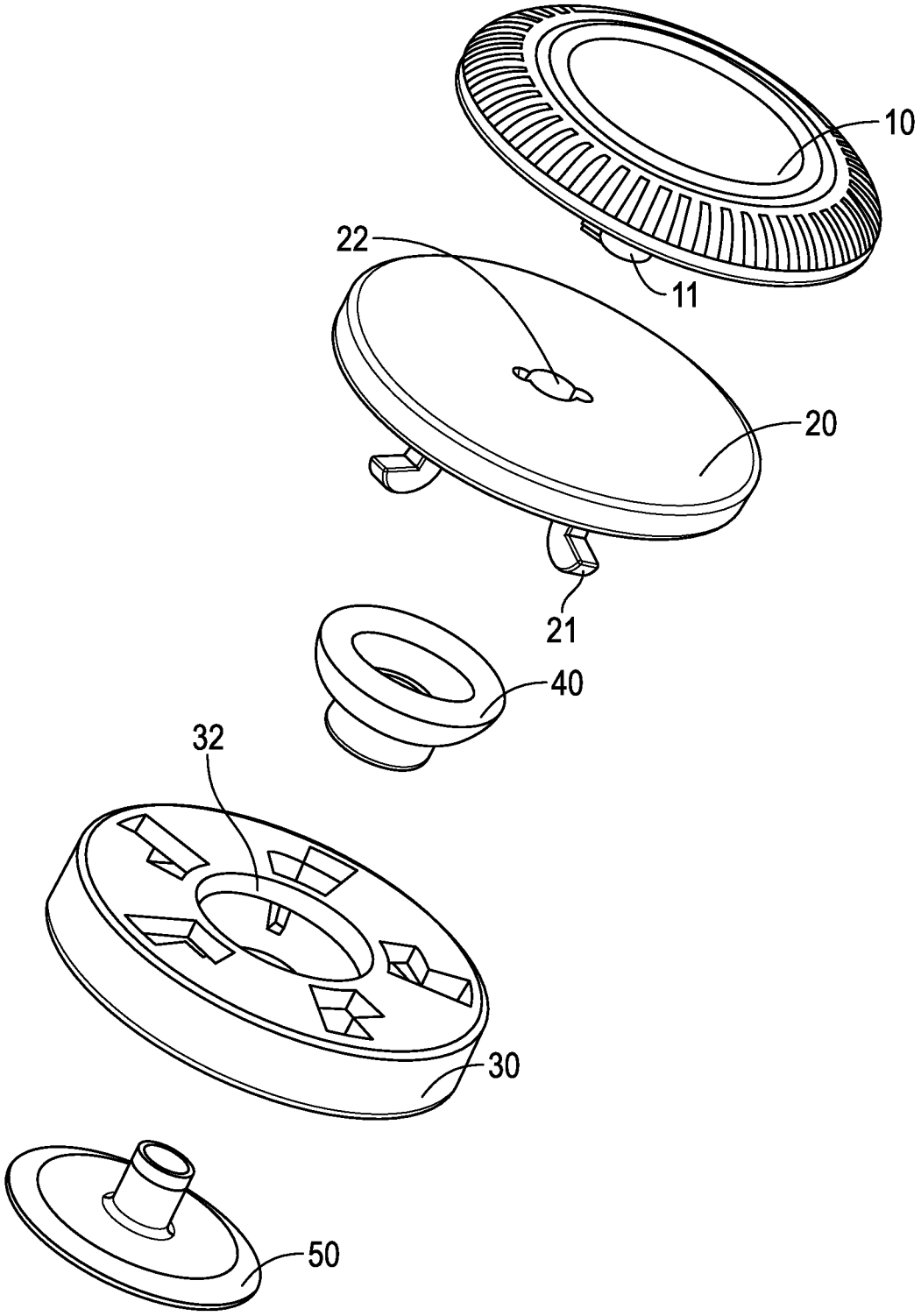
FIG. 6A is a semi-exploded angled view of the device shown in FIG. 4.

FIG. 6A is a semi-exploded view of the invention with the closed design for plate 30, and incorporates the detailed description of FIG. 3A above.

Figure 6B:
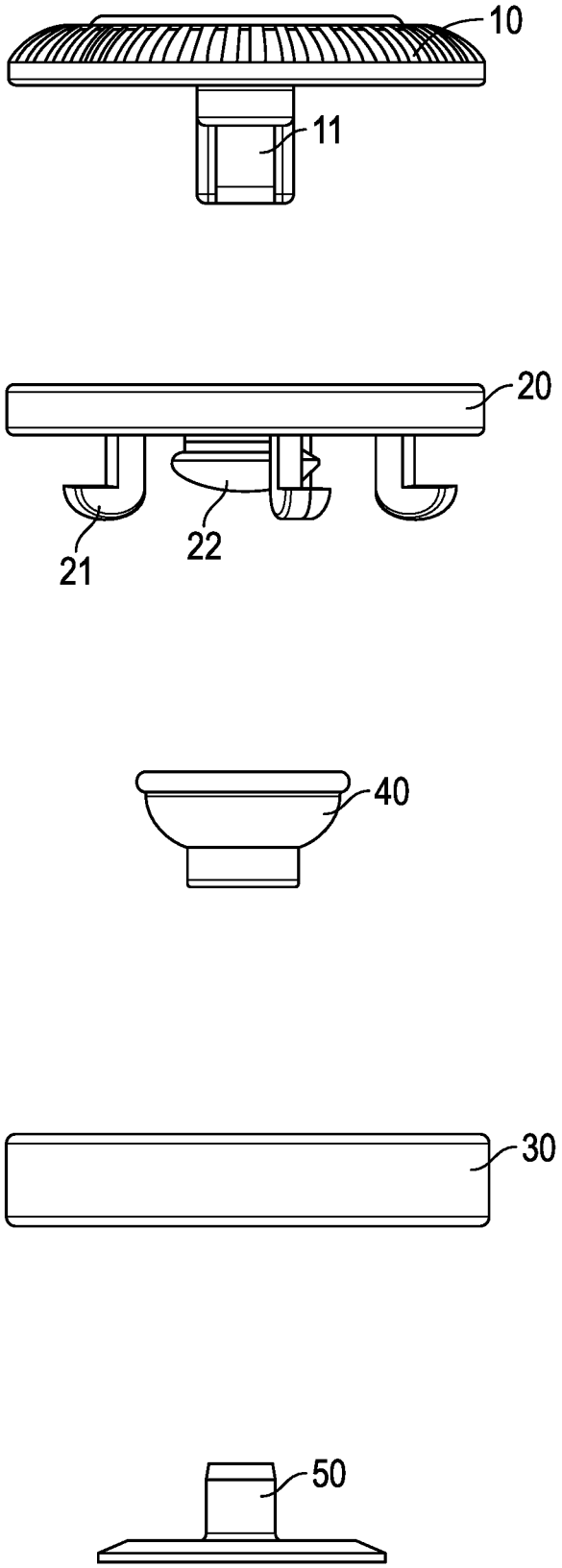
FIG. 6B is a semi-exploded front view of the device shown in FIG. 4.

FIG. 6B is a semi-exploded front view of the invention with the closed design for plate 30, and incorporates the detailed description of FIG. 3B above.

Figure 6C:
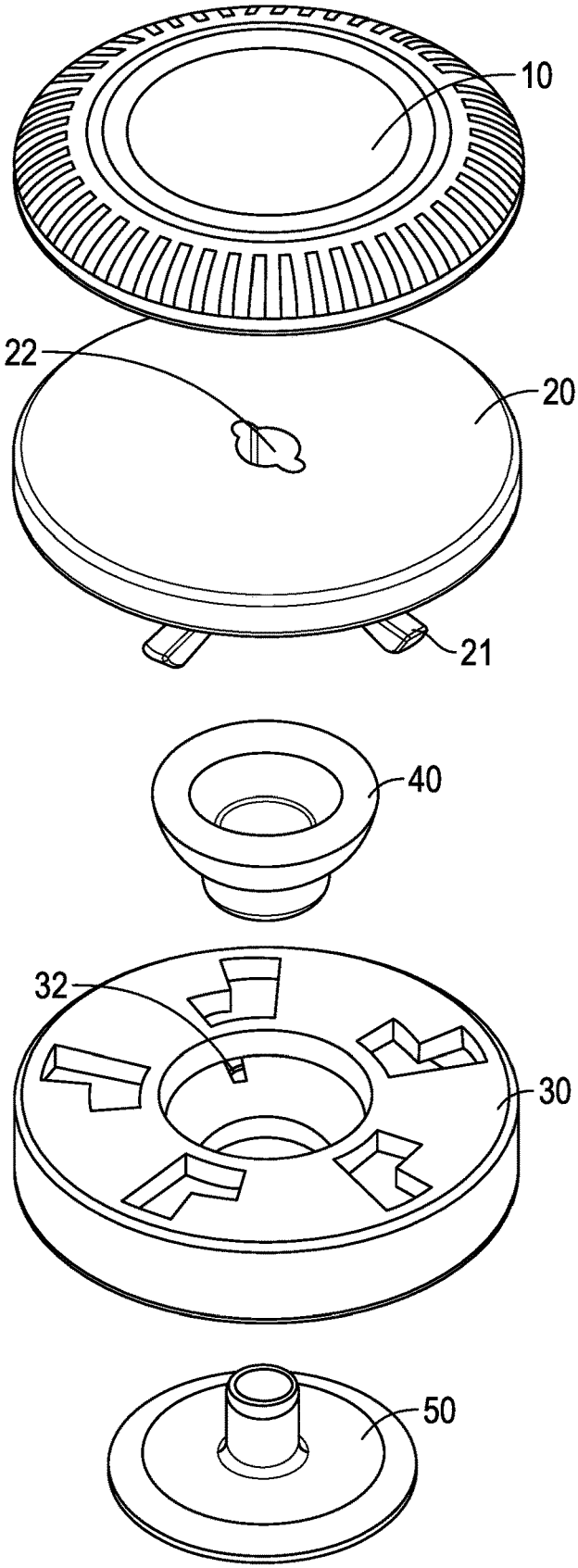
FIG. 6C is a semi-exploded front-angled view of the device shown in FIG. 4.

FIG. 6C is a semi-exploded front-angled view of the invention with the closed design for plate 30, and incorporates the detailed description of FIG. 3C above.

Figure 7:
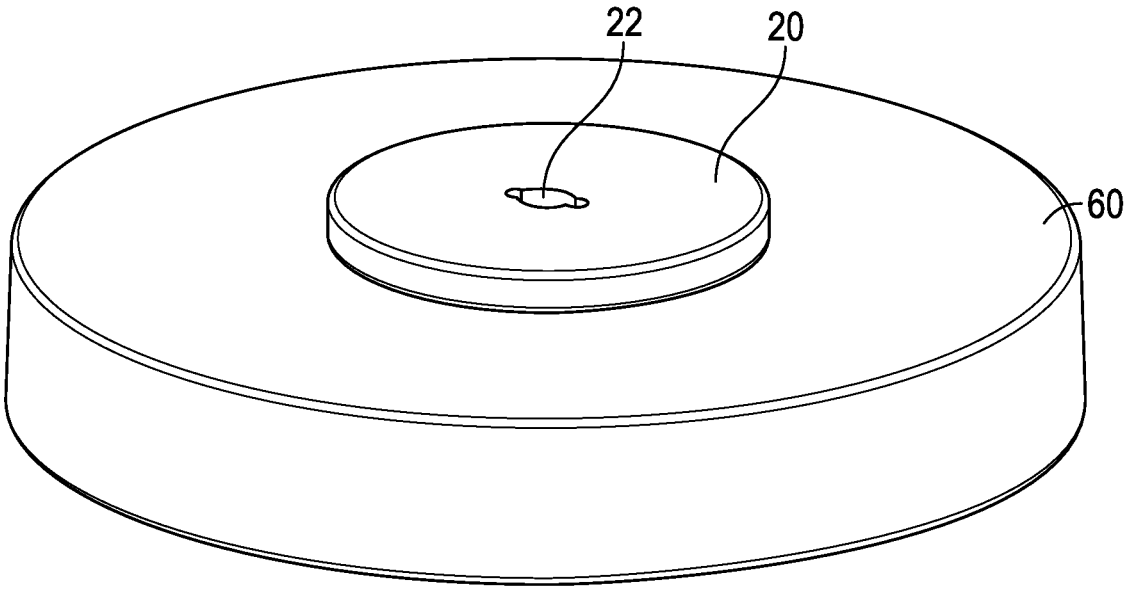
FIG. 7 is a front schematic view of the snap and lock button installation device.

FIG. 7 is a front-angled view of the plate 20 enclosed in installation device 60, said installation device holds the invention in place and guides installation and assembly of the invention.

Figure 8:
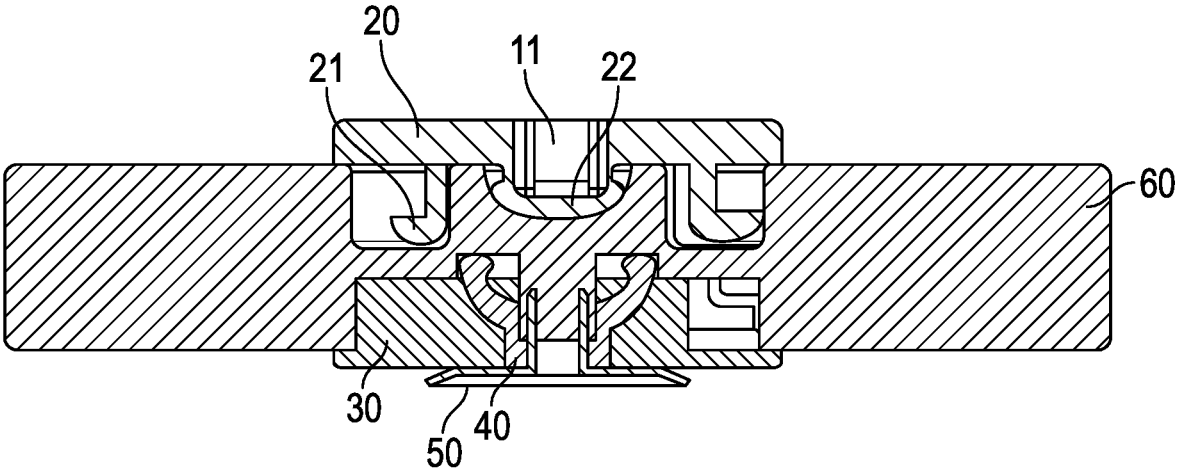
FIG. 8 is a cross-sectional view of the device shown in FIG. 7. taken from the center of the device with the open design.

FIG. 8 shows the cross-sectional view of the installation device 60 operating on the invention taken from the center of said device. In this FIG. 8, plate 30 is in the open design. The detailed description of FIG. 2 above is incorporated herein this FIG. 8.

Figure 9:
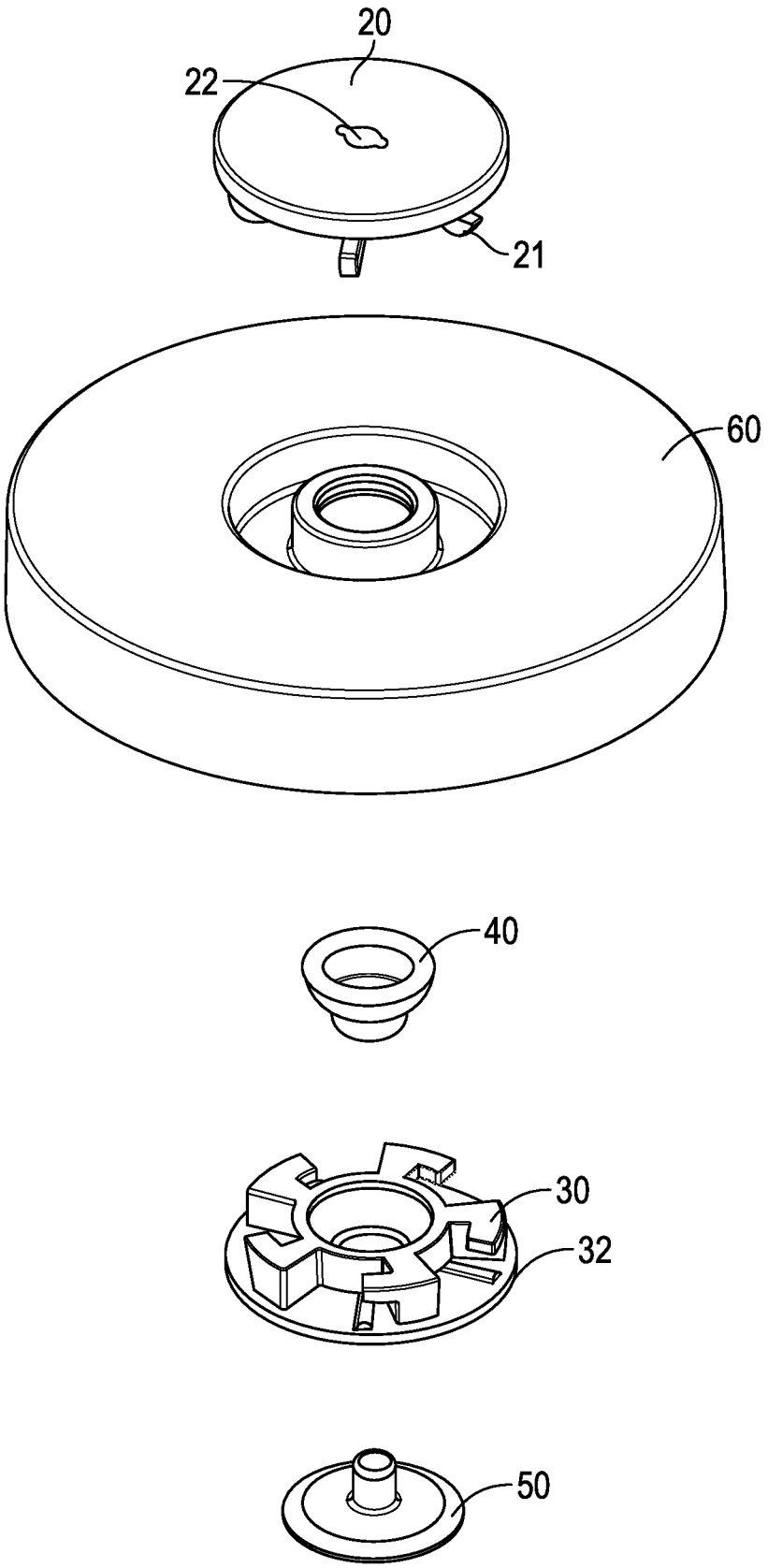
FIG. 9 is a semi-exploded front-angled view of the device shown in FIG. 7 with the open design.

FIG. 9 is a semi-exploded front-angled view of the installation device 60 operating on the invention while incorporating the detailed description of FIG. 3A above. In this FIG. 9, plate 30 is in the open design. Plate 10 is not shown in this FIG. 9.

Figure 10:
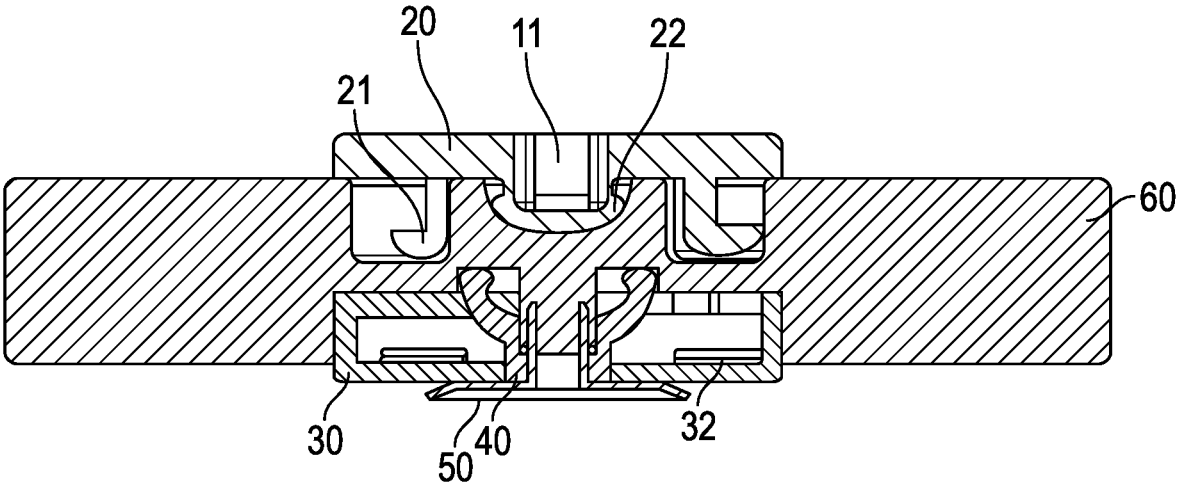
FIG. 10 is a cross-sectional view of the device shown in FIG. 7. taken from the center of the device with the closed design.

FIG. 10 shows the cross-sectional view of the installation device 60 operating on the invention taken from the center of said device. In this FIG. 10, plate 30 is in the closed design. The detailed description of FIG. 2 above is incorporated herein this FIG. 10.

Figure 11:
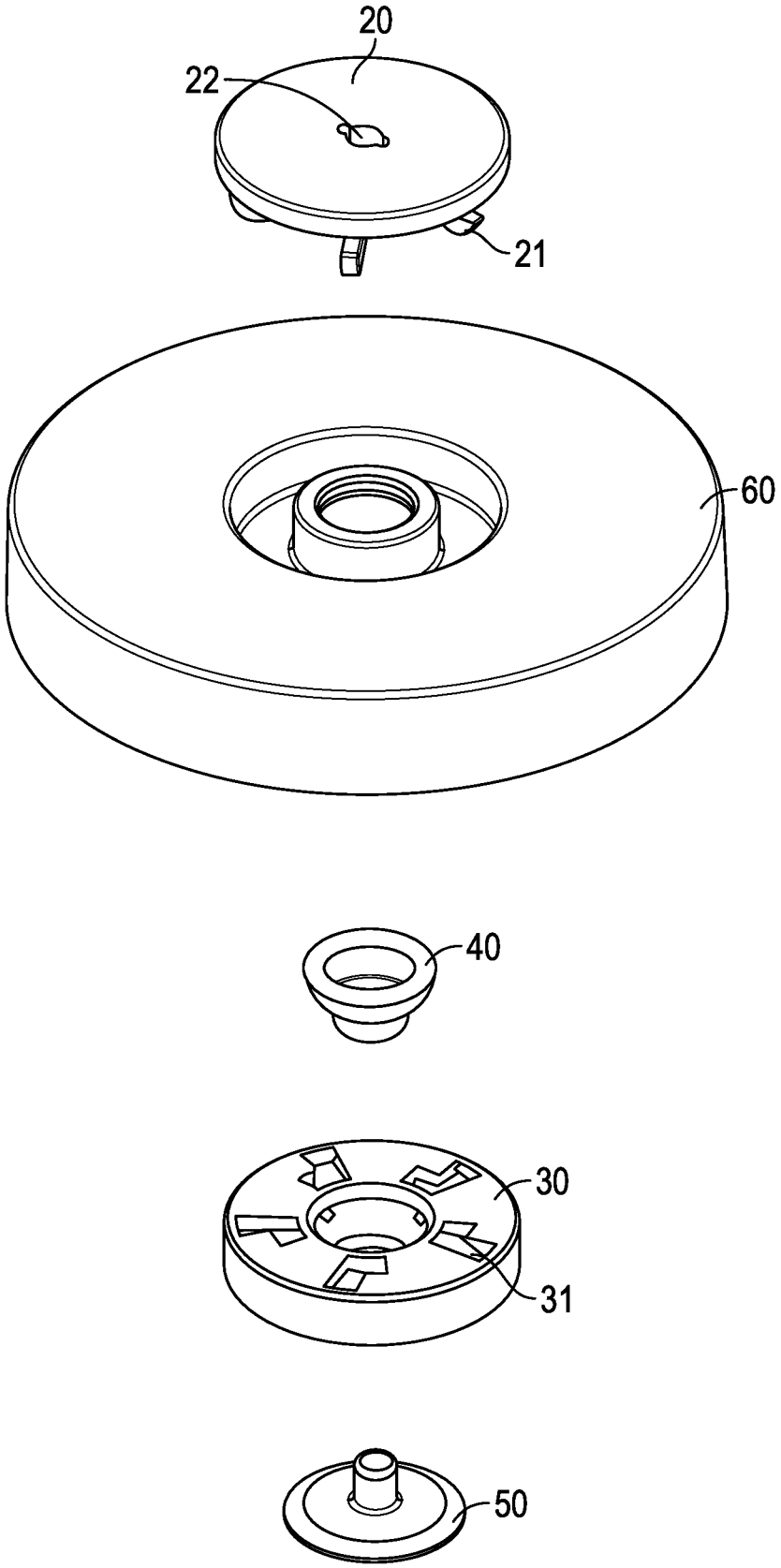
FIG. 11 is a semi-exploded front-angled view of the device shown in FIG. 7 with the closed design.

FIG. 11 is a semi-exploded front-angled view of the installation device 60 operating on the invention while incorporating the detailed description of FIG. 3A above. In this FIG. 11, plate 30 is in the closed design. Plate 10 is not shown in this FIG. 11.

What is claimed is:

1. A button system for an article of clothing or any item requiring fastening, said button system comprising: a top member and bottom member capable of incorporation into an article of clothing;

said top member consisting of a detachable, rotatable, and interchangeable ridged cover that is used as both a pressure point to secure said top member to said bottom member, a male fastener that attaches to said ridged cover, and a plate with L-shaped hinges and a female fastener to secure all components of the top member;

said bottom member consisting of a plate to receive said hinges from said top member, said plate with a cavity to allow the hinges to rotate counterclockwise 37 to 42 degrees into a locked position, and said plate with bumper guards to prevent the hinges from over rotation, and a rivet to attach to the article of clothing to the invention.

* * * * *